United States Patent [19]

Mason

[11] 4,145,838

[45] Mar. 27, 1979

[54] TOY BASKET GONDOLA

[76] Inventor: Charles P. Mason, 284 Cumberland Pkwy., Des Plaines, Ill. 60016

[21] Appl. No.: 766,668

[22] Filed: Feb. 8, 1977

[51] Int. Cl.[2] ..... A63H 33/00

[52] U.S. Cl. ..... 46/11; 46/89; 40/214

[58] Field of Search ..... 46/87, 88, 89, 74 R, 46/11; 40/214; 244/30, 31, 33; 206/217, 223

[56] References Cited

U.S. PATENT DOCUMENTS

| | | | |
|---|---|---|---|
| 1,478,755 | 12/1923 | Mulholland | 46/89 |
| 1,648,934 | 11/1927 | Brinkmann | 46/89 X |
| 1,994,202 | 3/1935 | Sarsfield | 46/89 |
| 2,383,390 | 8/1945 | Jacobs | 46/89 X |
| 2,701,935 | 2/1955 | Florence | 46/88 |
| 2,840,948 | 7/1958 | Stickley | 46/88 |
| 3,366,999 | 2/1968 | Darby | 46/88 |

*Primary Examiner*—Russell R. Kinsey
*Assistant Examiner*—Mickey Yu
*Attorney, Agent, or Firm*—Dressler, Goldsmith, Clement, Gordon & Shore, Ltd.

[57] ABSTRACT

A lighter than air toy consisting of a basket gondola made of a light plastic or other material attached to the bottom of a toy balloon filled with a gas less dense than air, such as helium. The balloon, when inflated with a gas less dense than air, provides the buoyancy to lift the gondola into the air and allows it to rise freely or float at a predetermined level. Ballast weights can be added to the gondola to balance the buoyancy force so that the force of gravitation on the gondola and balloon is exactly balanced by the buoyant force whereby the gondola and balloon assembly together have a neutral buoyancy in the air. The basket gondola and balloon are held together by means of stretching the knot of the balloon through a keyhole slot made in the basket gondola. The knot is held in place by wedging it into the thin part of the keyhole slot. This invention is simple to make and put together. The basket gondola can be used as a childs toy or for advertising promotion.

4 Claims, 9 Drawing Figures

TOY BASKET GONDOLA

BACKGROUND OF THE INVENTION

This invention relates to an aerial toy, the object of which is to provide a toy that will rise or float in the air.

SUMMARY OF THE INVENTION

The toy includes the use of a toy basket gondola, made of very light plastic or other light material, that is attached to the knotted end of a balloon filled with a lighter than air gas such as helium. The gas provides the buoyancy to overcome the weight of the basket gondola.

Numerous other advantages and features of the present invention will become readily apparent from the following detailed description of the invention and embodiments thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENTS

Figure 1:
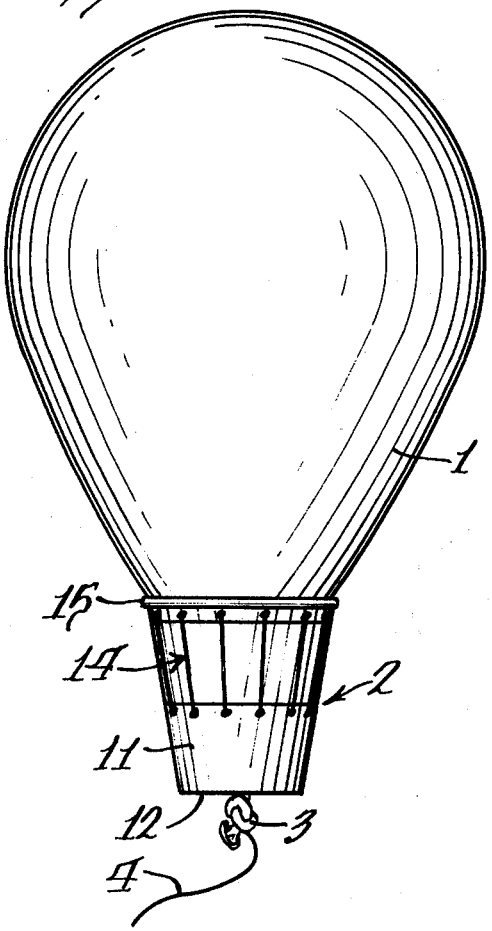
FIG. 1 is a side view of a first embodiment of the combined variable ballast gondola and holder of the present invention shown assembled with an inflated balloon.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

Figure 3:
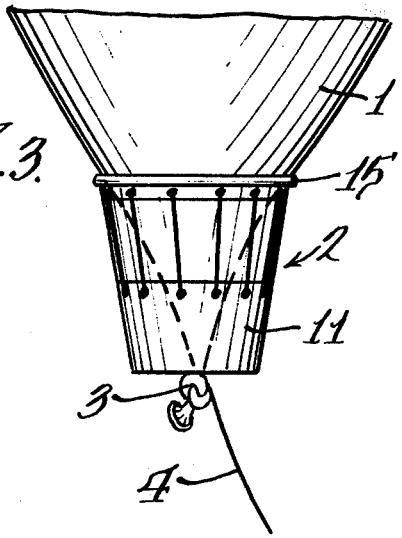
FIG. 3 is a fragmentary side view of the first embodiment of the present invention.
Figure 4:
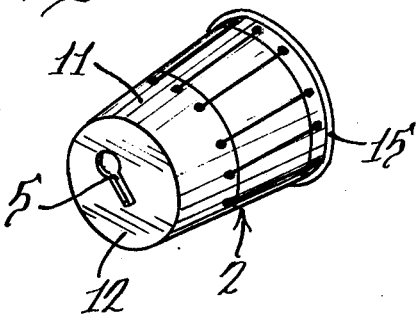
FIG. 4 is a perspective view of the gondola of the first embodiment of the invention illustrated in FIG. 3.

Referring now to FIGS. 1, 3 and 4, a variable ballast gondola and holder 2 for an inflated balloon 1 is illustrated in accordance with the present invention. The gondola 2 has the form of a generally cup-like container frustoconical in shape and having peripheral upstanding wall means 11 (with a printed design 14 thereon) and having a bottom wall means 12. The cup-like container has a circumferential upper edge surface 15 for engaging or bearing against the inflated balloon 1. The inflation filler tube of the balloon is knotted, after the balloon has been inflated, with a knot 3 which is brought down through the gondola 2 into engagement with a slot means or slot 5 (FIG. 4). The slot 5 is preferably defined in the bottom wall of the gondola 2 and is preferably keyhole-shaped.

When the knotted portion 3 of the fill tube is pulled down through the keyhole-shaped slot 5, the circumferential upper edge surface 15 of the frustoconical peripheral upstanding wall 11 bears against the balloon 1 and holds it securely in place. With this embodiment, weight may be easily added to the gondola 2 by pushing a portion of the balloon 1 away from the circumferential, upper edge surface and letting small ballast pieces drop into the gondola. Typically, small items, such as marbles or coins, would be used for this purpose.

A string 4 may be secured to the balloon, such as at the knot 3. The balloon may be prevented from floating away by holding the string 4.

Weight can be added either inside the basket or attached to the outside or on the string to provide ballast, achieving equilibrium which allows the balloon to float in midair.

The gondola 2 can be moulded into any shape and painted with colorful designs to make it appealing, and space on the outside can be provided for affixing advertising logos.

The present invention can be used in various ways. By proper adjustment of the weights or ballast in or on the gondola 2, the balloon and gondola assembly can be left to rise freely into the air and to float freely in the air. It can also be held in check by means of the string 4. By adding a proper amount of ballast, the balloon can be made to float at a specific height in the air. Horizontal forces can be applied to the balloon, either by externally generated air currents or by directly touching the balloon with the hand or with an extension member, to move the gondola horizontally through the air in a particular flight pattern. By properly weighting the gondola, the balloon can be made to land in a specified area. With a gondola and balloon assembly having a slight negative buoyancy, games can be played wherein the balloon is propelled through the air with the objective of propelling it to land in a specified area.

Figure 2:
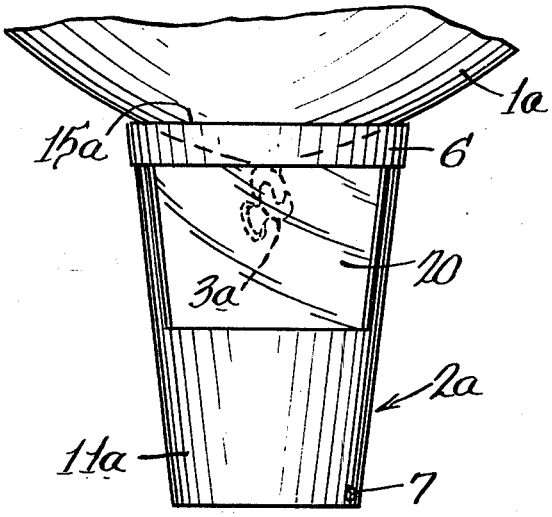
FIG. 2 is an enlarged side view of a second embodiment of the present invention with a transparent insert sheet included.
Figure 5:
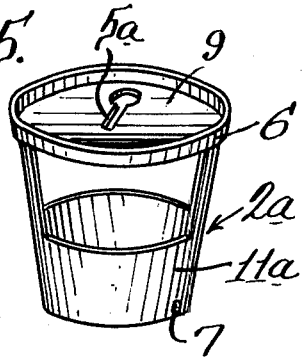
FIG. 5 is a perspective view of the second embodiment of the present invention illustrated in FIG. 2 with the insert sheet removed.

A second embodiment of the present invention is illustrated in FIGS. 2 and 5. The gondola 2*a* comprises a generally cup-like structure, similar to that described with reference to the embodiment illustrated in FIG. 1, but further having an upper wall means or connected lid 9 defining a keyhole-shaped slot 5*a* therein. An upwardly projecting rim 6 is provided on the periphery of the lid 9. The balloon inflation fill tube knot 3*a* is pushed through the large opening of the keyhole-shaped slot 5*a* and the fill tube is moved laterally from the large open portion of the keyhole-shaped slot into the narrow portion of the slot whereby the knot 3*a* is retained against the lid 9 and cannot pass through the narrow portion of the keyhole-shaped slot. The balloon 1*a* then rests upon the rim 6 which is in bearing engagement therewith. The keyhole-shaped slot 5*a* is seen to be below, or recessed from, the top of the rim 6. Therefore, when the knot 3*a* is placed in the keyhole-shaped slot, the balloon material must be stretched and an upward force continuously biases the knot against the underside of the lid and in engagement with the narrow portion of the keyhole-shaped slot.

A lower lip or hole 7 can be provided in the gondola 2*a* to which a string (not illustrated) can be secured for holding the balloon and gondola assembly in the air.

Weights can be added directly to the gondola 2a for adjusting buoyancy.

In FIG. 2, the gondola 2a is shown with a cut out area in the upstanding wall means 11a against which is placed an insert sheet 20 bearing printed designs, advertising, or the like. The sheet 20 has been removed from the gondola 2a in FIG. 5.

The openings in the peripheral upstanding wall means in the second embodiment illustrated in FIG. 5 allow the ballast or weight to be added directly through the openings to the bottom of the gondola.

Figure 6:
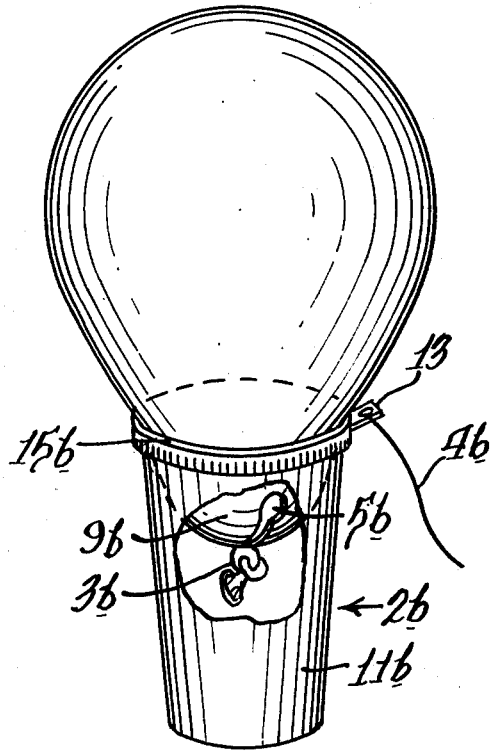
FIG. 6 is a perspective view of a third embodiment of the present invention.
Figure 7:
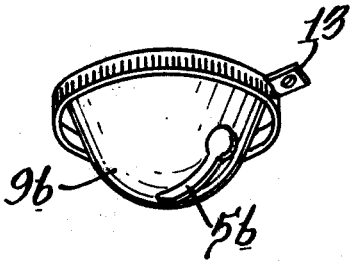
FIG. 7 is a perspective view of the lid of the third embodiment of the present invention.

A third embodiment of the present invention is illustrated in FIGS. 6 and 7. A gondola 2b is provided having a generally frustoconical shape with a removably engageable lid 9b. The lid 9b is inwardly concave with respect to the gondola 2b and is adapted to receive a portion of the balloon 1b within the concave volume defined by the lid 9b. The lid 9b also has therein a keyhole-shaped slot 5b for receiving and engaging the knotted portion 3b of the balloon inflation fill tube. The lid 9b also has a circumferential upper edge surface 15b for bearing against the inflated balloon 1b.

Preferably, the lid 9b is of the typical snap-on type which is used with drinking cups and the like and the lower portion of the gondola preferably is an actual drinking cup. The cup and/or the lid may be printed or decorated with various designs including designs that may simulate the appearance of large scale, hot air balloons that are used to carry people. Further, advertising material and the like may be printed on the cup or gondola 2b.

The lid 9b may also have a tab, such as tab 13 projecting outwardly therefrom to which a string 4b may be attached to hold the assembly for (1) preventing the assembly from floating away or (2) guiding the assembly, such as when it is used in a game where such guidance may be required.

If ballast is to be added, the lid 9b can be unsnapped from the lower container portion to allow the admission of ballast material therein. Subsequently, the lid can be re-engaged with the lower container.

Figure 8:
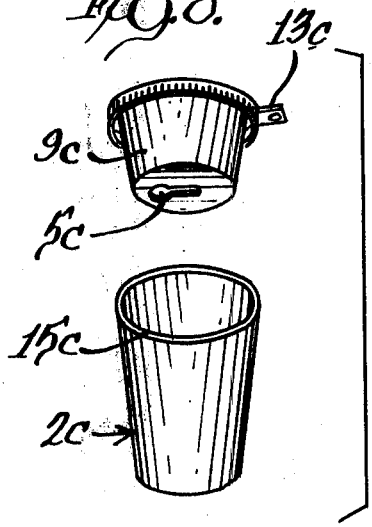
FIG. 8 is an exploded, perspective view of a fourth embodiment of the present invention.

A fourth embodiment of the present invention is illustrated in FIG. 8 wherein the lid 9c is illustrated as having a substantially frustoconical shape as opposed to a hemispherical concave shape of the lid 9b illustrated in FIG. 7.

Figure 9:
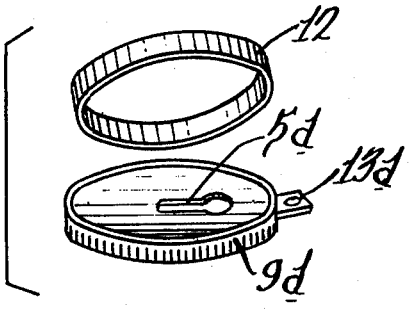
FIG. 9 is an exploded, perspective view of a fifth embodiment of the present invention.

A fifth embodiment of the present invention is illustrated in FIG. 9. A removable, substantially flat lid 9d with a slot 5d is provided for use with a cup to form a gondola. However, in order to provide a volume for receiving a portion of an inflated balloon, a separate removable ring 12 is provided for mounting to the top of the lid. In this respect, the lid 9d and ring 12 cooperate to operate in much the same manner as the integral lid 9 and rim 6 illustrated for the second embodiment in FIG. 5. Of course, the lid 9d and ring 12 could be molded in one piece if desired.

The lids may be transparent or opaque, and the lower cup-like portions of the gondola may be transparent and adapted to receive cylindrical paper inserts having various designs, emblems or advertising materials printed thereon. This would eliminate the need for printing of the gondola cup or basket portion.

It is thus seen that the present invention can be quickly assembled and, if used in conjunction with a drinking cup, as illustrated in FIGS. 6 through 9, may induce the consumer to reuse the drinking cup to form the apparatus of the present invention. This may reduce litter.

The apparatus of the present invention is also seen to be safe and reusable. Further, the present invention, though contemplated for use with helium filled balloons, can nevertheless be used with regular air filled balloons and the gondolas can be used many times with various types of balloons.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A combination variable ballast gondola and holder for an inflated balloon comprising:

a container having peripheral upstanding wall means and bottom wall means, said container further having a circumferential, upper edge surface adapted to bear against an inflated balloon, said container including a lid means opposite said bottom wall means and defining a slot means therein for engaging the knotted inflation tube of an inflated balloon and for holding the balloon tight against said upper edge surface of said container whereby the buoyancy of the assembly of the gondola and balloon may be varied by adding ballast to said container.

2. The apparatus in accordance with claim 1 in which said lid means is removably engageable with said peripheral upstanding wall means.

3. The apparatus in accordance with claim 1 in which said upper edge surface is defined by an upstanding ring member mounted on said lid.

4. The apparatus in accordance with claim 1 in which said lid is inwardly concave with respect to said gondola and is adapted to receive a portion of the balloon within the concave volume of the lid.

* * * * *